US006222456B1

(12) United States Patent
Tice

(10) Patent No.: US 6,222,456 B1
(45) Date of Patent: Apr. 24, 2001

(54) DETECTOR WITH VARIABLE SAMPLE RATE

(75) Inventor: Lee D. Tice, Bartlett, IL (US)

(73) Assignee: Pittway Corporation

( * ) Notice: Subject to any disclaimer, the term of this patent is extended or adjusted under 35 U.S.C. 154(b) by 0 days.

(21) Appl. No.: 09/164,498

(22) Filed: Oct. 1, 1998

(51) Int. Cl.[7] ..... G08B 17/10

(52) U.S. Cl. ..... 340/630; 340/628; 340/629; 340/578; 250/574; 356/438

(58) Field of Search ..... 340/628, 629, 340/630, 632, 578, 584, 589; 250/574, 575; 356/436, 437, 438, 439

(56) References Cited

U.S. PATENT DOCUMENTS

| | | |
|---|---|---|
| 3,922,656 | 11/1975 | Horvath et al. . |
| 4,068,130 | 1/1978 | Malinowski . |
| 4,075,499 | 2/1978 | Malinowski . |
| 4,088,986 | 5/1978 | Boucher . |
| 4,093,867 | 6/1978 | Shah et al. . |
| 4,125,779 | 11/1978 | Malinowski . |
| 4,186,390 | 1/1980 | Enemark . |
| 4,206,456 | 6/1980 | Malinowski . |
| 4,470,047 | 9/1984 | Vogt et al. . |
| 4,490,715 | 12/1984 | Kusanagi et al. . |
| 4,525,704 | 6/1985 | Campbell et al. . |
| 4,575,711 | 3/1986 | Suzuki et al. . |
| 4,638,304 | 1/1987 | Kimura et al. . |
| 4,640,628 | 2/1987 | Seki et al. . |
| 4,644,331 | 2/1987 | Matsushita et al. . |
| 4,667,106 | 5/1987 | Newman . |
| 4,688,021 | 8/1987 | Buck et al. . |
| 4,697,172 | 9/1987 | Kimura . |
| 4,749,986 | 6/1988 | Otani et al. . |
| 4,749,987 | 6/1988 | Ishii . |
| 4,763,115 | 8/1988 | Cota . |
| 4,803,469 | 2/1989 | Matsushita . |
| 4,831,361 | 5/1989 | Kimura . |
| 4,833,450 | 5/1989 | Buccola et al. . |
| 4,884,222 | 11/1989 | Nagashima et al. . |
| 4,975,684 | 12/1990 | Guttinger et al. . |
| 5,005,003 | 4/1991 | Ryser et al. . |
| 5,026,992 | 6/1991 | Wong . |
| 5,053,754 | 10/1991 | Wong . |
| 5,079,422 | 1/1992 | Wong . |

(List continued on next page.)

FOREIGN PATENT DOCUMENTS

| | | |
|---|---|---|
| 0 180 085 A2 | 10/1985 | (EP) . |
| 0 274 042 A2 | 11/1987 | (EP) . |
| 0 517 097 A2 | 5/1992 | (EP) . |
| 0 865 013 A2 | 3/1998 | (EP) . |

OTHER PUBLICATIONS

The Search Report issued Nov. 26, 1999 on Broitish Application No. GB 9923181.3 (counterpart application of above identified application (3 pages).

*Primary Examiner*—Jeffery Hofsass
*Assistant Examiner*—Anh La
(74) *Attorney, Agent, or Firm*—Rockey, Milnamow & Katz, Ltd.

(57) ABSTRACT

A detector includes a sensor of an ambient condition. Outputs from the sensor are sampled at a predetermined rate when the outputs do not represent an alarm condition. The outputs are analyzed using pattern recognition techniques to determine if a predetermined profile, which precedes the presence of an alarm condition, is present. In the event that the profile is detected, the sample rate is increased along with associated sample value processing. The detector includes a programmable processor coupled to the sensor. The processor includes pattern recognition instructions for detecting the presence of the predetermined profile. The processor also includes instructions for altering the sampling rate in response to the detected presence of the profile. A second sensor can be incorporated to provide sample rate altering signals.

39 Claims, 7 Drawing Sheets

U.S. PATENT DOCUMENTS

| | | | |
|---|---|---|---|
| 5,100,479 | | 3/1992 | Wise et al. . |
| 5,103,096 | | 4/1992 | Wong . |
| 5,159,315 | | 10/1992 | Schultz et al. . |
| 5,163,332 | | 11/1992 | Wong . |
| 5,168,262 | | 12/1992 | Okayama . |
| 5,218,440 | | 6/1993 | Mathur . |
| 5,227,972 | | 7/1993 | Jacobson . |
| 5,255,556 | | 10/1993 | Lobdell . |
| 5,276,434 | | 1/1994 | Brooks et al. . |
| 5,282,261 | | 1/1994 | Skeirik . |
| 5,341,214 | | 8/1994 | Wong . |
| 5,369,397 | | 11/1994 | Wong . |
| 5,376,924 | | 12/1994 | Kubo et al. . |
| 5,526,280 | | 6/1996 | Consadori et al. . |
| 5,592,147 | | 1/1997 | Wong . |
| 5,612,674 | | 3/1997 | Tice . |
| 5,659,292 | | 8/1997 | Tice . |
| 5,764,142 | | 6/1998 | Anderson . |
| 5,767,776 | | 6/1998 | Wong . |
| 5,798,700 | | 8/1998 | Wong . |
| 5,801,633 | | 9/1998 | Soni . |
| 5,864,293 | * | 1/1999 | Lewiner et al. ..... 340/630 |

* cited by examiner

DETECTOR WITH VARIABLE SAMPLE RATE

FIELD OF THE INVENTION

The invention pertains to ambient condition detectors. More particularly, the invention pertains to photoelectric-type smoke detectors with variable sample rates.

BACKGROUND OF THE INVENTION

Smoke detectors have been extensively used to provide warnings of potential or actual fire conditions in a region being monitored. Photoelectric-type smoke detectors sample the contents of a smoke chamber intermittently.

Known photoelectric detectors sample the smoke chamber at a first rate in a quiescent state. In the event that a smoke sample exceeds a preset threshold, the sample rate is increased. If the level of smoke exceeds a threshold for several additional samples, an alarm condition will be indicated.

While known detectors do provide a variable sample rate, it is only in response to the presence of a predetermined smoke density. It would be desirable to be able to vary the rate even for low levels of smoke density without requiring the excessive power that can be required to operate continuously at a relatively high sample rate. Preferably such added functionality could be achieved without any significant increase in either cost or manufacturing complexity.

SUMMARY OF THE INVENTION

A detector samples an ambient condition at a predetermined rate. Circuitry in the detector analyzes the sampled values as they are being received. If the values meet a predetermined profile, such as a profile of a developing fire, the sampling rate is increased.

In one aspect, the circuitry recognizes the presence of a predetermined profile based on processing samples from an ambient condition sensor. For example, if three amplitude values in a row consecutively increase, the sample rate can be increased. If four sampled amplitudes in a row consecutively increase, the sample rate can again be increased.

Recognizing a pre-established profile and increasing the sample rate in response thereto provides additional benefits. Other processing such as smoothing of the sampled values to eliminate uncorrelated noise or carrying out other forms of preliminary processing will be accelerated due to the increased sample rate.

Yet another benefit of the present apparatus and process is that the average power consumption of the respective detector is only increased when the likelihood of a condition to be detected has increased. In systems having large numbers of detectors, the ability to reduce average power or current is particularly advantageous.

In yet another aspect, other recognizable profiles which can be used to produce increased sample rates include increased gradient values of the sampled amplitudes or the value of an integral of the sampled amplitudes. An alternate way in which a sample rate modifying profile can be established is to incorporate a second, different sensor into the detector.

The output signal from the second sensor can be processed. If a selected profile is recognized, the sample rate of the primary sensor can be increased.

Hence, where a selected profile has been recognized, the sample rate will be increased. If the profile is no longer being recognized, perhaps due to changing ambient conditions, the sample rate can be returned to its quiescent value. As a result, average power consumption will be reduced.

In yet another aspect, a detector can include multiple sensors. These multiple sensors can include a fire sensor or a non-fire sensor as a second sensor. In the case of more than one fire sensor, the sampling rate would increase if more than one fire sensor is giving an indication of a fire condition. In the case of the non-fire sensor, the sampling rate of the fire sensor would not increase or would decrease if the non-fire sensor is giving an indication of a non-fire condition.

A particular detector could include a photo-electric, optical, type sensor and an ionization sensor. These are normally sampled at a 5 second rate. Methods of implementing variable sampling for this example are:

a. if either sensor senses a potential fire condition, then the sampling interval of both the optical sensor and the ionization sensor will be decreased to 2.5 seconds; or b. if the optical sensor senses a potential fire condition, the sampling interval of the ionization sensor will be decreased to 2.5 seconds. This reverse situation results in decreasing the sampling interval of the optical sensor; or c. if both sensors sense a fire condition, then the sampling interval of both sensors will be decreased to 2 seconds (Otherwise, the sampling intervals are unchanged); or d. if neither sensor senses a potential fire condition, then the sampling interval will be increased to 7.5 seconds.

Alternately, the sampling rate could increase linearly with the level of indication of the sensed condition. For example the sample interval could be shortened from a 5 second interval, with no indication, to a 4 second interval with a mild indication, to a 3 second interval with a stronger indication. Finally, the interval can be reduced to a 2 second interval with a very strong indication.

The rate is alterable by downloading different values into the detectors from a common control unit. The common control unit may determine that other devices are sensing a condition and set the remainder of the system or certain other devices to increase their sampling rate.

In yet another aspect, where the sampled signal is processed or filtered, both the sampling rate and the processing can be altered in response to a recognized fire profile. For example, where a predetermined profile has been recognized:

a) the sampling rate can be increased, (and the interval decreased) and the type of filtering changed or the degree of filtering decreased—both promote a faster response; or b) the sampling rate can be increased—to promote a faster response—without altering the type or degree of filtering— thereby providing more information and a greater discrimination of a developing ambient condition; or c) where there are two sensors, if one sensor is responsive to nuisance or false alarm causing conditions, the sampling rate of both sensors could be increased along with increasing the filtering of one or both sensor outputs to minimize false alarms.

Numerous other advantages and features of the present invention will become readily apparent from the following detailed description of the invention and the embodiments thereof, from the claims and from the accompanying drawings.

DESCRIPTION OF THE PREFERRED EMBODIMENT

Figure 1:
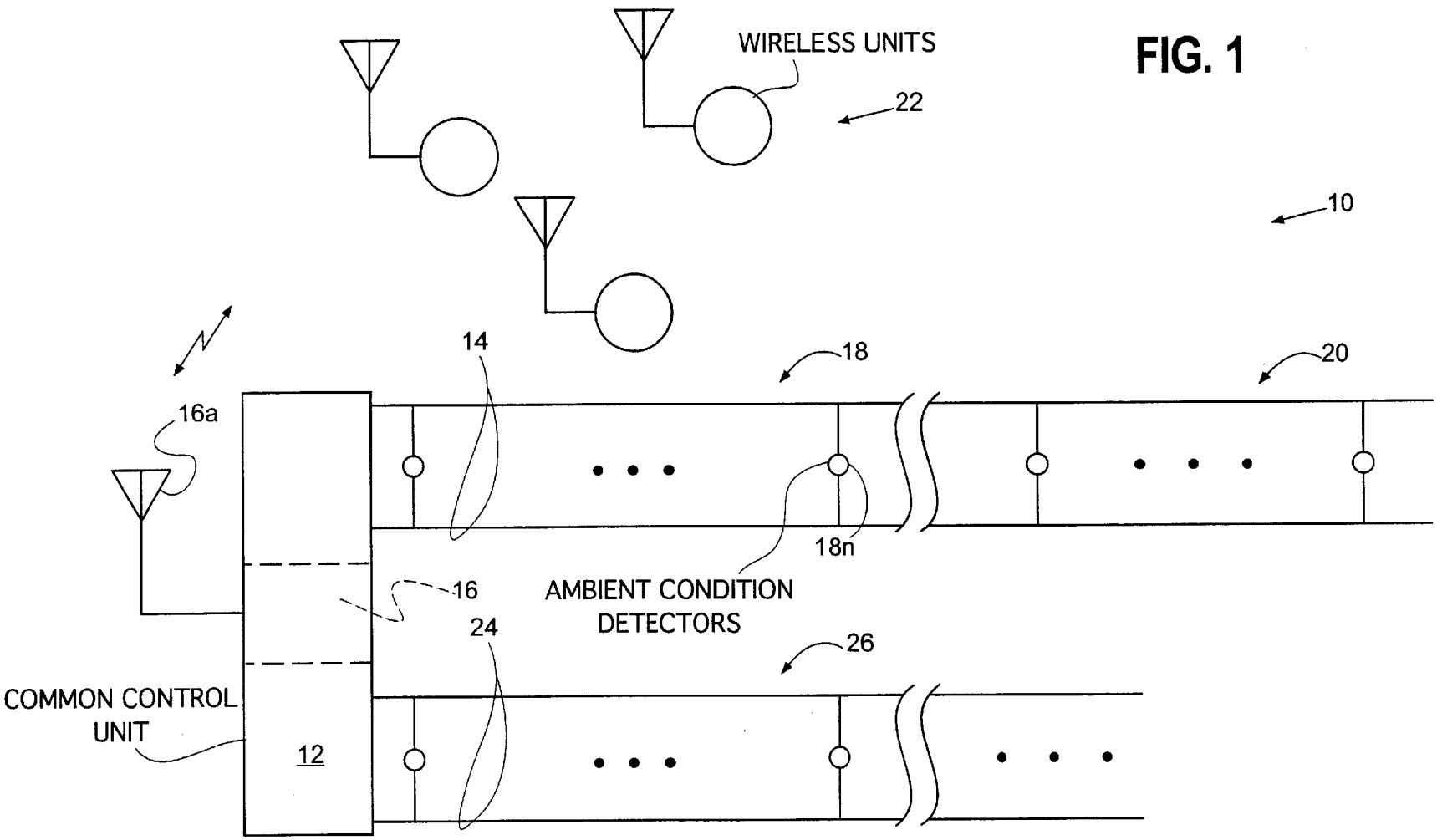
FIG. 1 is a block diagram of a system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 which can be used for monitoring a plurality of conditions in one or more regions to be supervised. The system 10 includes a common control unit 12 which could be implemented as one or more interconnected programmed processors and associated, prestored instructions.

The unit 12 includes an interface for coupling, for example, to a communications medium 14, illustrated in FIG. 1 for exemplary purposes only as an optical or electrical cable. Alternately, the system 10 can communicate wirelessly, such as by RF or infrared, via transceiver 16, illustrated in phantom in FIG. 1, and antenna 16*a*.

Coupled to medium 14 is a plurality of ambient condition detectors 18 and a plurality of control or function units 20. It will be understood that the relative arrangement of the members of the pluralities 18 and 20 relative to the medium 14 is not a limitation of the present invention. The members of the plurality 18 can include intrusion sensors, position sensors, gas sensors, fire sensors such as smoke sensors, thermal sensors or the like, and gas sensors, all without limitation. The members of the plurality 20 can include solenoid actuated control or function implementing units, display devices, printers or the like.

Where system 10 incorporates a wireless communications medium, a plurality 22 of wireless units could be in bidirectional communication with transceiver 16. The plurality 22 can include, without limitation, ambient condition detectors, as noted above as well as control or function implementation devices without limitation.

Also coupled to the control unit 12 via a medium 24, illustrated for example as a pair of electrical cables, is a plurality 26 of output devices. These could include audible or visible output devices without limitation, speech output devices and the like. The devices 26 are intended to broadcast a message, which might indicate alarm condition, in one or more predetermined regions.

Figure 2:
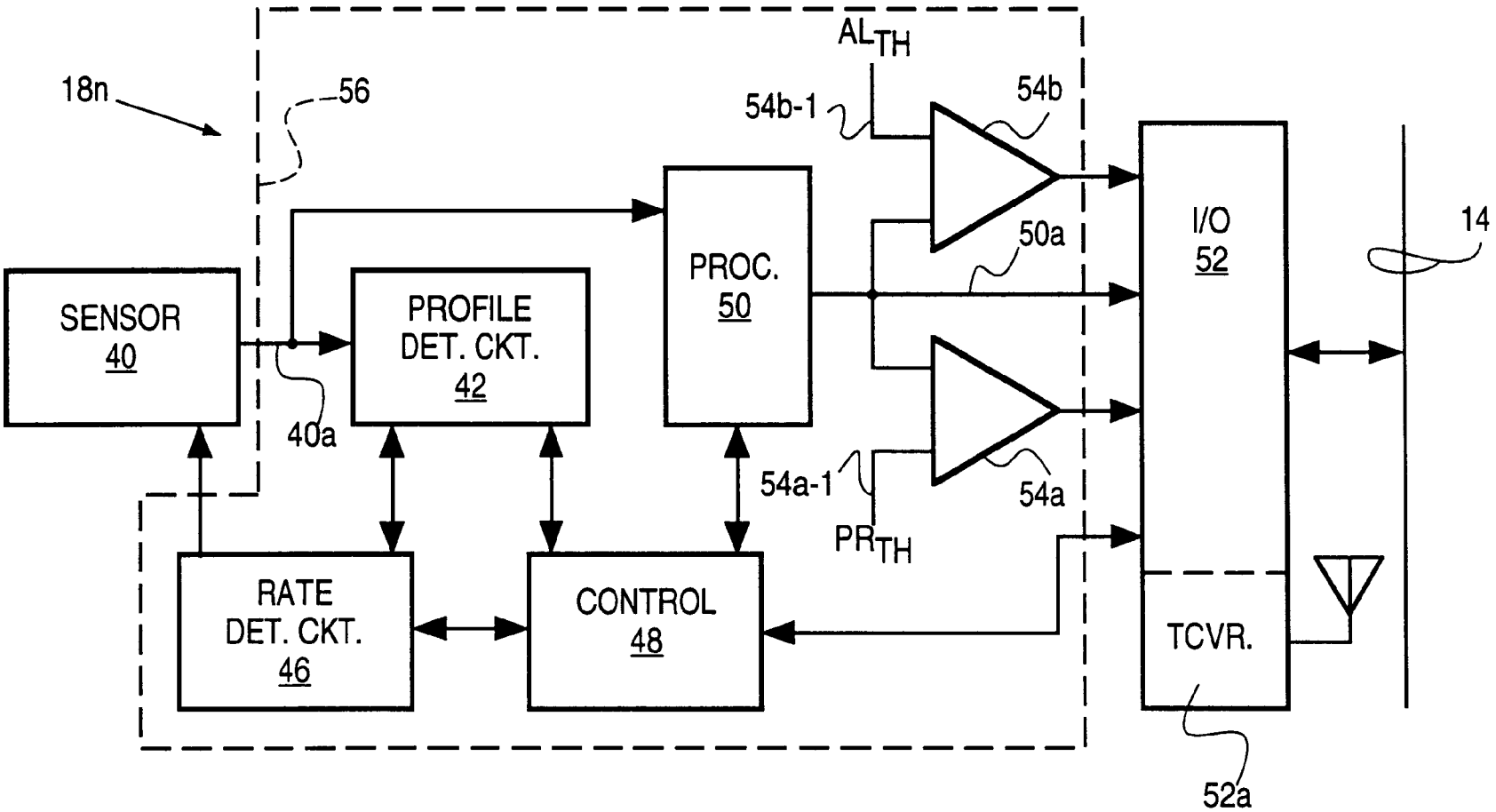
FIG. 2 is a block diagram of an ambient condition detector useable with the system of FIG. 1.

FIG. 2 illustrates in block diagram form an exemplary member 18*n* of the plurality 18. The member 18*n*, an ambient condition detector, includes an ambient condition sensor 40.

The sensor 40 can include without limitation a smoke sensor such as a photo electric sensor, ionization sensor, gas sensor, humidity sensor or the like. Output from the sensor 40, on a line 40*a* is coupled to profile detection circuitry 42.

In a quiescent operating state, the sensor 40 can be intermittently energized at a quiescent rate to provide a sampled output on the line 40*a*. Alternately, signals on the line 40*a* can be sampled at the quiescent rate.

Profile detection circuitry 42 is a intended to analyze the output from sensor 40, line 40*a* to establish the presence of a possible alarm condition (for example, a possible fire condition or a possible hazardous gas condition) even before a preset threshold, such as a pre-alarm condition, is crossed. When an appropriate profile has been detected by circuitry 42, sampling rate determination circuitry 46, coupled to profile detection circuitry 42, alters, by increasing, the sampling rate of the signal on the line 41*a*. The sampling rate thus goes from the quiescent rate to a predetermined higher rate.

Altering of the sampling rate can be achieved by incorporating into circuitry 46 analog circuitry such as voltage controlled oscillators or digital circuitry such as counters and the like all without departing from the spirit and scope of the present invention. It will also be understood that other forms of sampling rate altering circuitry also fall within the scope of the present invention. Circuitry 46 can intermittently energize sensor 40 or it can provide gating signals to the signal on the line 40*a*, all without departing from the spirit and scope of the present invention.

By means of circuitry 46, since the sampling rate of signals from sensor 40 can be increased in response to the detection of a potential alarm condition, response of the detector 18*n* to the ambient condition being sensed will be speeded up. In addition, average power required for the detector 18*n* will be reduced since in the absence of a detected profile, detector 18*n* operates at a lower sampling rate, thus conserving energy.

Profile detection circuitry and sampling rate determination circuitry 42, 46 are coupled to local control circuitry 48. Control circuitry 48 can in turn control the operation of signal processing circuitry 50 which can provide various types of pre-processing or filtering of signals from sensor 40 prior to coupling those signals via interface circuitry 52 to either medium 14 or wireless transceiver 52*a*.

It will further be understood that processing circuits 50 can be implemented wholly or in part in detector 18*n* as well as wholly or in part in common control unit 12 without departing from the spirit and scope of the present invention. One form of pre-processing is disclosed in Tice et al U.S. Pat. No. 5,736,928, assigned to the assignee hereof, entitled Pre-Processor Apparatus and Method and incorporated herein by reference. Three sample processing, so called min-three processing is described and illustrated therein.

The processed outputs on line 50*a* could in addition be coupled to the comparators 54*a, b*. It will be understood that the comparators 54*a, b* could be implemented in hardware or software at the detector 18*n*. Alternately, that functionality can be provided at common control unit 12.

Where sensor 40 is intended to detect the presence of a fire condition, pre-alarm comparator 54*a* compares processed sensor output, line 50*a* to a pre-alarm threshold 54*a*-1 so as to provide an early indication of the presence of a possible fire condition. In addition, processed sensor output is compared in comparator 54*b* to an alarm threshold 54*b*-1 which is indicative of the presence of a substantial enough indication of a fire that an alarm, which could be given via members of the plurality 26, should be provided. It will be understood that other variations are possible beyond the pre-alarm threshold and alarm threshold illustrated in FIG. 2, all without departing from the spirit and scope of the present invention.

Since the profile detection circuitry 42 is intended to address a developing ambient condition, various analysis approaches can be implemented. One profile can be based on a rate of change of sensor output signals. For example, circuitry 42 can detect the presence of increasing amplitude values on the line 40*a*. This rate can be compared to a preset rate. Where amplitude values on the line 40*a* assume a random distribution, no profile of interest is present. Hence, a relatively long quiescent sample interval, on the order of six seconds can be established.

In the event that the signal on the line 40*a* exhibits increasing amplitude for three successive sample values, the sample interval can be reduced from six seconds to two seconds irrespective of the amplitude value on the line 40*a*. Similarly, if desired, if the amplitude increases for four successive samples, the sampling interval can be decreased from 2 second intervals to one second intervals. As a result, the processing circuits 50 will receive samples at a substantially higher rate. These samples will then be analyzed either at the detector 18*n* or at the common control unit 12 to determine the presence of an alarm condition.

It will be understood that other types of profile detection can be used without departing from the spirit and scope of the present invention. For example, the sensor output signal can be integrated over time or averaged to create a profile.

Figure 3:
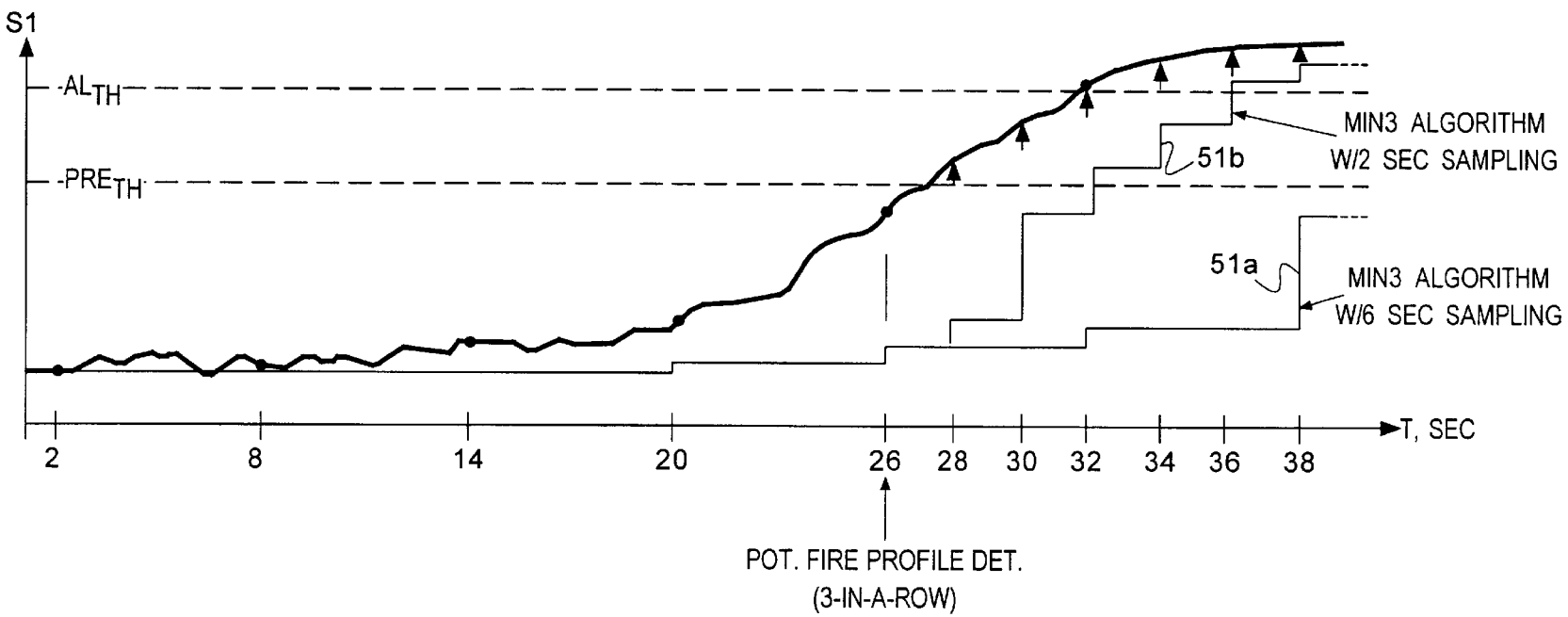
FIG. 3 is a graph illustrating processing of signals from detector of the type illustrated in FIG. 2.

FIG. 3 includes a graph which illustrates the above processing where the profile detector 42 responds to three successive increasing amplitude values on the line 40*a*. As illustrated in FIG. 3, where the output on line 40*a* from sensor 40 exhibits random values, in a two second through 20 second time period, a quiescent sample rate having six second intervals is used. At 26 seconds, a preliminary potential fire profile is detected by circuitry 41 in response to detecting three increasing amplitude values in a row. At 26 seconds, the profile detection circuitry 42 causes the sampling rate determination circuitry 46 to switch from a six second interval to a two second interval.

51*a* illustrates processed output values on the line 50*a* on the assumption that the sample rate has not increased. 51*b* illustrates process sample values on the line 50*a* in response to a shortened sample interval. The processing circuitry 50, for example, carries out the type of min-three processing described in the above identified Tice et al patent that was incorporated by reference.

As illustrated in FIG. 3, as a result of having increased the sample rate at 26 seconds, the processed values on the line 50*a* graph 51*b* cross the prealarm threshold $PR_{TH}$ sooner than do those of graph 5l*a* where the sampling rate has not been increased. Similarly, the processed signals on the line 50*a* cross the alarm threshold $AL_{TH}$ sooner than is the case without increasing the sample rate. Hence, not only do the present apparatus and process result in a lower power requirement a since during quiescent periods the sample rate for the respective detectors is reduced, but they also produce shorter response intervals due to a higher sample rate when the ambient condition being detected begins to change. Using a higher sample rate, once a preliminary fire profile has been detected, takes advantage of a greater probability of the presence of an actual fire as reflected by that preliminary profile.

It will be understood that the circuitry 42 through 50 and 54*a, b* of FIG. 2 could be implemented wholly or in part via a programmed processor 56 (illustrated in phantom) in the detector 18*n*.

Figure 4:
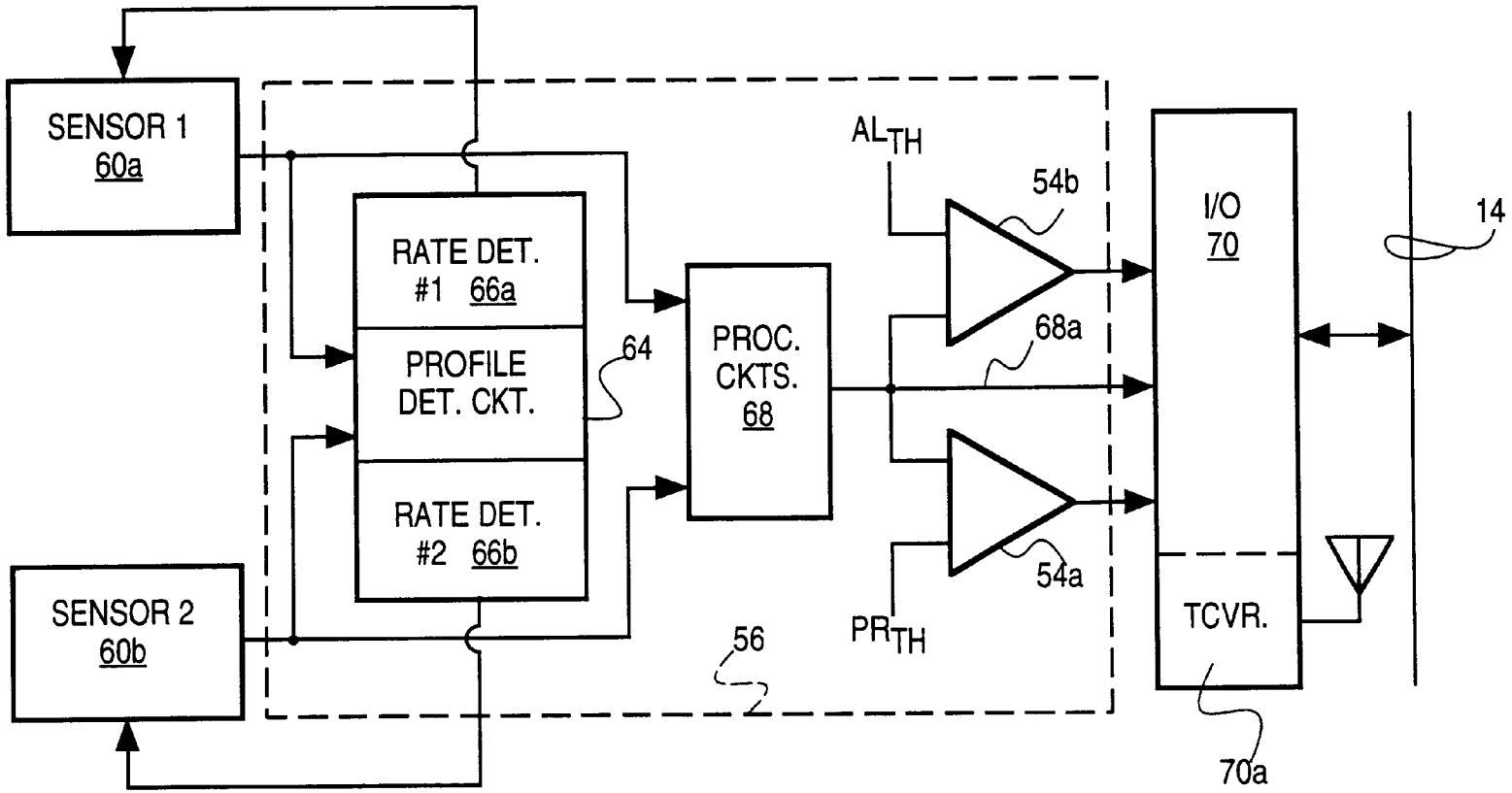
FIG. 4 is a block diagram of an alternate form of the detector usable with the system of FIG. 1.

FIG. 4 illustrates an alternate form of a detector 18*p* in accordance herewith. Detector 18*p* incorporates first and second ambient condition sensors 60*a, b*. Sensor outputs on respective lines 62*a* and 62*b* are coupled to profile detection circuitry 64.

In the detector 18*p*, the profile detection circuitry utilizes signals on the line 62*b* to establish the sampling rate for sensor 60*a*. Circuitry 64 uses samples on the line 62*a* to establish a sampling rate for sensor 60*b*.

Profile determination circuitry 64 is in turn coupled to rate determination circuitry 66*a, b* for the respective sensors, 60*a* and 60*b*. Outputs from sensors 60*a, b* can in turn be coupled to processing circuitry 68, of the type discussed in the above noted Tice et al patent, and then transmitted via interface circuitry 70 to medium 14 or via transceiver 70*a*, wirelessly, to control unit 12.

For example, profile determination circuitry 64 via rate determination circuitry 66*a, b* can establish in a clear air or quiescent condition a five or six second sample interval. If, for example, sensor 60*a* is an optical-type smoke sensor and 60*b* is an ionization-type smoke sensor, increasing detected levels of smoke represent a potential fire condition. Variable sampling via circuitry 66*a, b* can be implemented as follows:

if either sensor 60*a*, or 60*b* provide an output to the profile determination circuitry 64 which corresponds to a potential fire profile, the sampling rate of both sensors 60*a*, 60*b* can be increased by reducing the sampling interval from on the order of five to six seconds to on the order of two and one-half to three seconds. Alternately, if neither sensor produces signals which are indicative of a developing fire profile, circuitry 64 in combination with rate determination circuitry 66*a, b* will ultimately reduce the sampling rate by increasing the sampling interval to on the order of seven and one-half or eight seconds.

It will be understood that profile detecting circuitry 64 can detect a rate of change of a sensor input to establish the presence of a predetermined profile. Alternately, detection circuitry 64 could implement any other form of a fire profile without departing from the spirit and scope of the present invention.

Figure 5A:
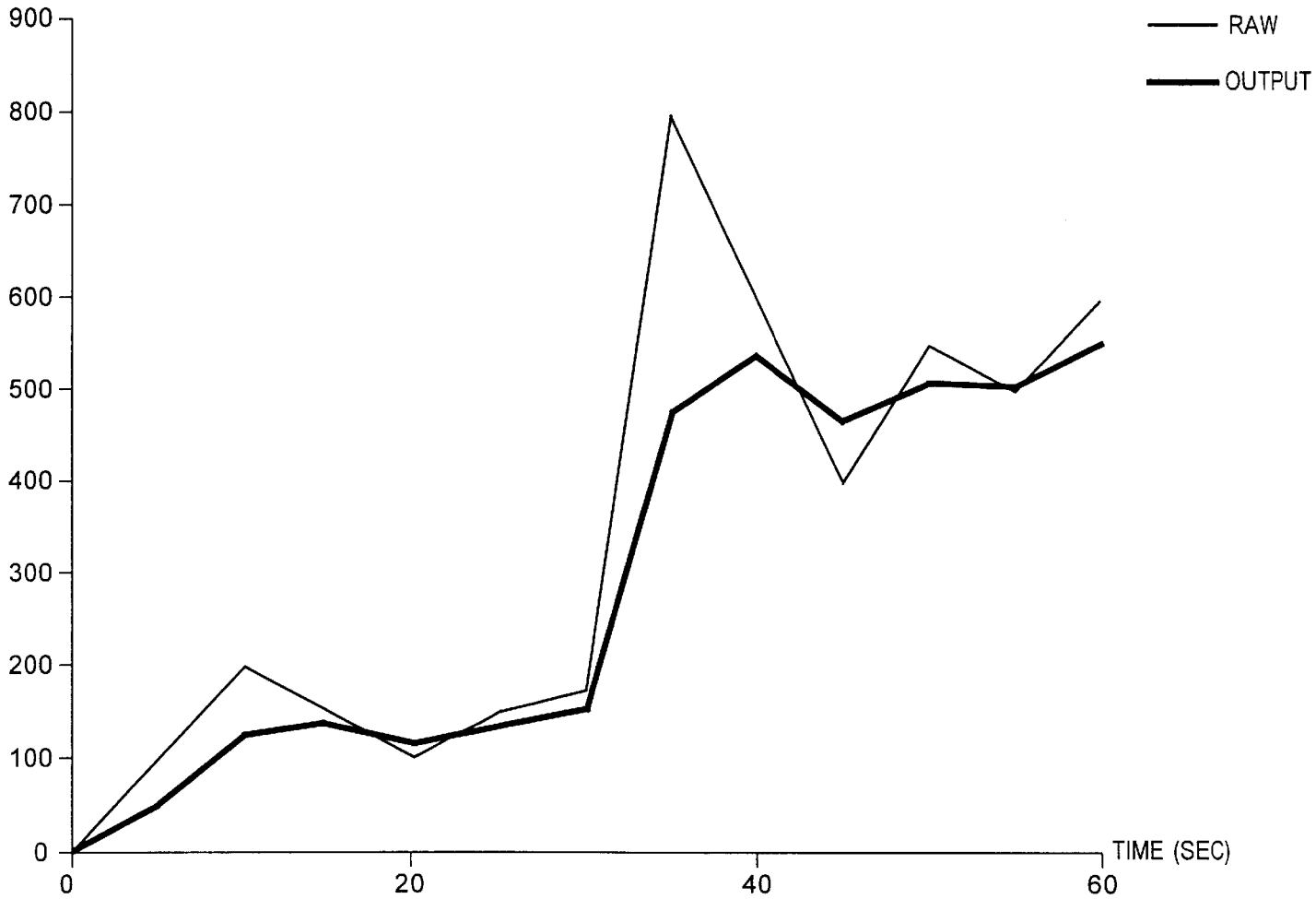
FIG. 5A illustrates raw sensor output and a filtered output corresponding thereto plotted as a function of time.
Figure 5B:
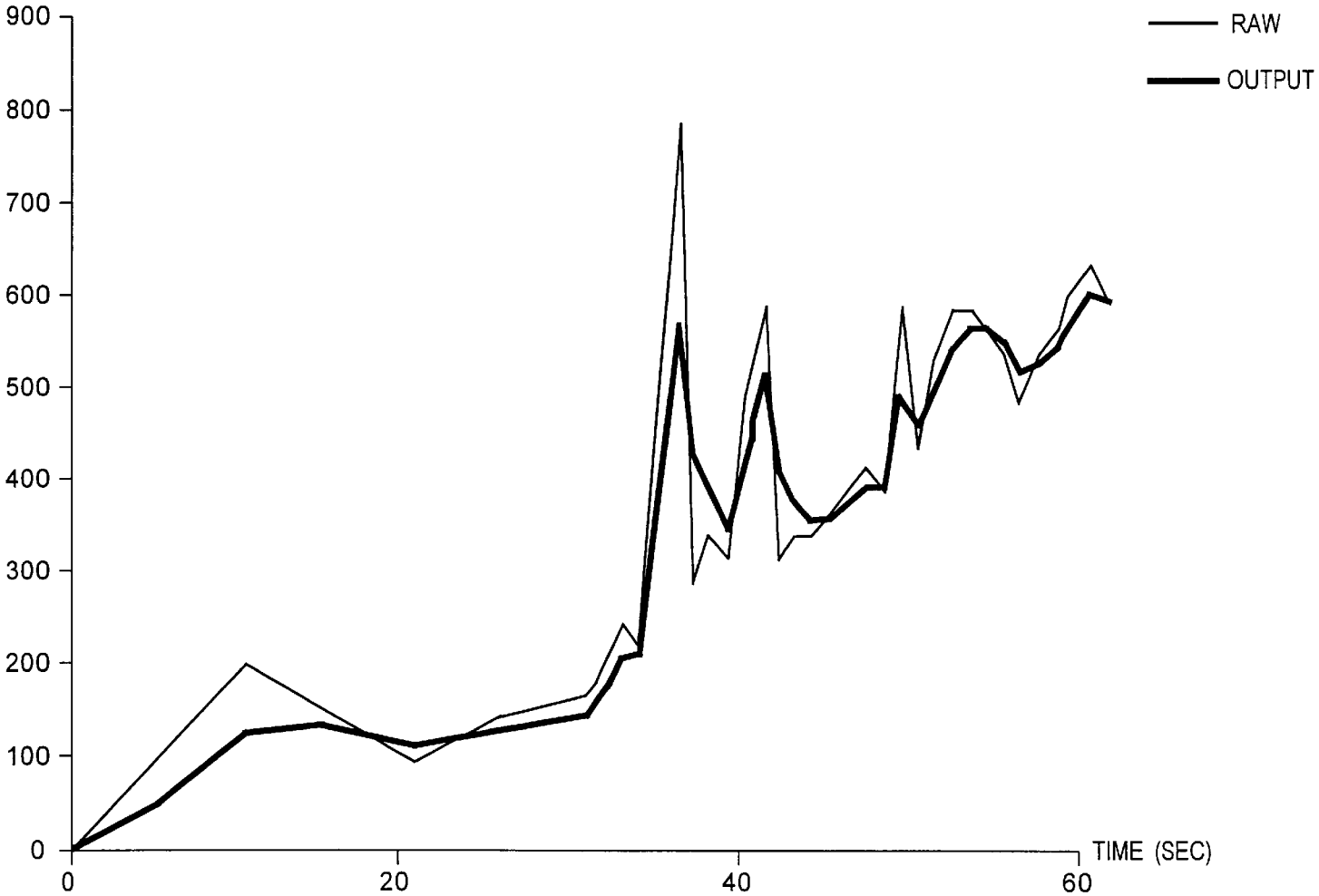
FIG. 5B illustrates the effects of increasing the sample rate using the same degree of filtering as was the case of the graph of FIG. 5A.
Figure 5C:
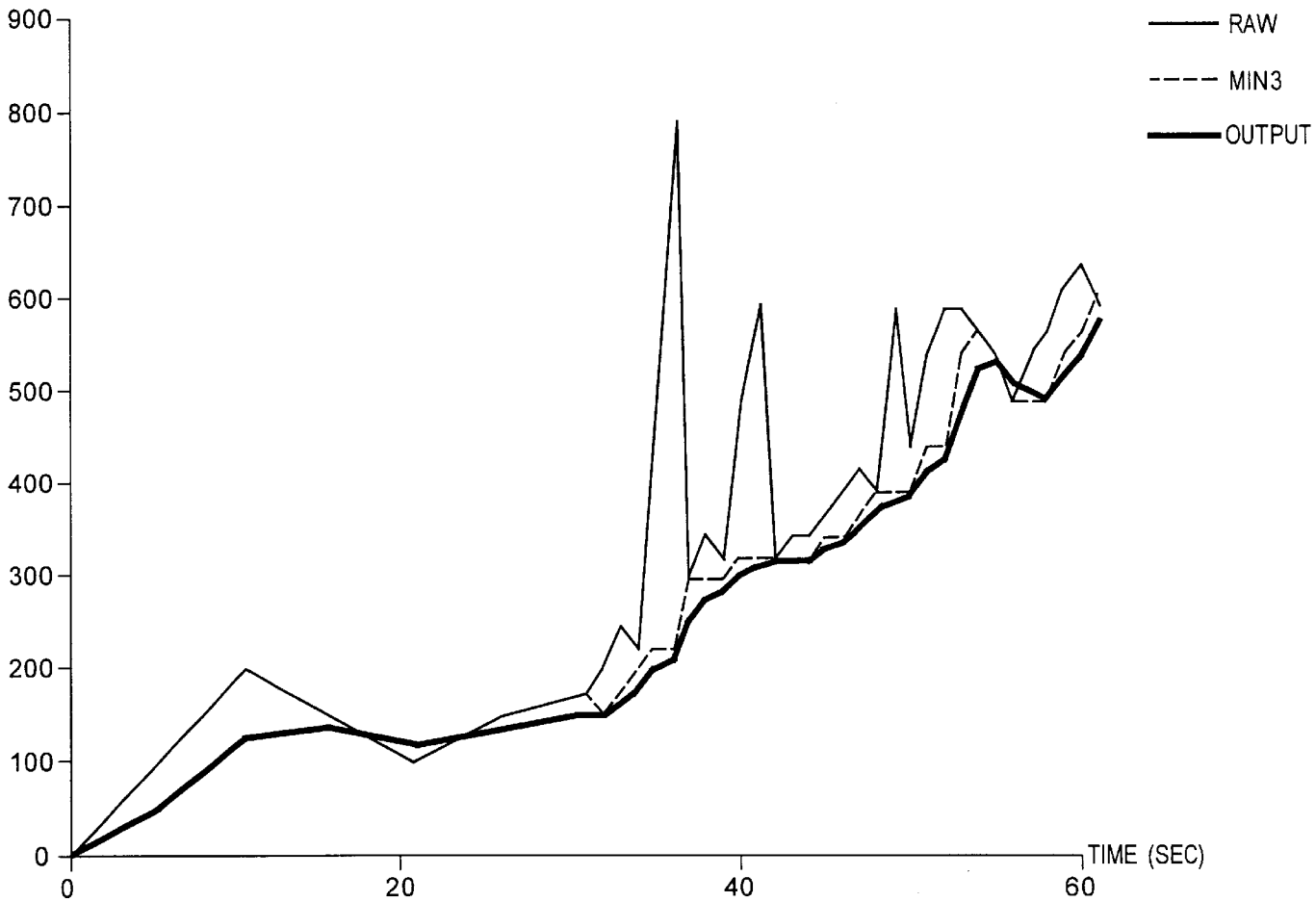
FIG. 5C illustrates the effects of combining increased sample rate with additional processing to provide a higher degree of fire discrimination than is the case with the response of FIG. 5A but in the same time interval.

FIGS. 5A–5C illustrate the results of changes in the processing when the sampling rate is increased. This is an example of performance of a smoke detector but it can apply, without limitation, to any other type of ambient condition detector.

The graph of FIG. 5A illustrates processed output:

$$\text{output}(t)=\text{output}(t-1)*0.5+RAW(t)*0.5$$

when the sampling rate is NOT increased. (RAW(t)is the unprocessed signal from a smoke sensor). The output takes the shape of a step function. The final values reach 550 at 60 seconds.

The graph of FIG. 5B illustrates the output when processed using the above equation except the sampling rate is increased by 5. The output now has higher resolution and takes a better shape indicating a fire profile but still has spikes that are out of profile. The final values reach over 600 at 60 seconds.

The graph of FIG. 5C illustrates the introduction of additional processing (min3) of the processed output when the sampling rate is increased. The min3 processing removes the spikes from the processed "output" signal that results from the above noted filtering process. A strong fire profile is present in the min3 processed output signal.

The added processing has improved the ability to discriminate a fire from a nuisance when the sampling rate is increased. The values still exceed 550 at 60 seconds, thus not significantly compromising the response time of FIG. 5A. As illustrated, changing the processing method when the sampling rate is changed can dramatically improve the overall performance.

Changing of the processing method in conjunction with an altered sampling rate can be as simple as changing the type or degree of filtering or can be implemented by adding new routines where the processing is carried out via software based commands.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An electrical unit comprising:

a sensor for generating an output;

a control element coupled to the sensor wherein the element includes circuitry for sampling the output of the sensor at a first rate thereby producing a sampled output, decision circuitry for determining if the sampled output exhibits a predetermined, non-threshold based, profile, and circuitry which in response thereto, increases the sampling rate to a second, higher, rate.

2. A unit as in claim 1 wherein the control element comprises a programmed processor with instructions for increasing the sampling rate from the first rate to the second rate in response to the presence of the profile in the output.

3. A unit as in claim 2 wherein the decision circuitry comprises additional instructions for recognizing the presence of the profile.

4. A unit as in claim 2 wherein the decision circuitry includes instructions which determine that the profile is present in response to sampled values exhibiting an increasing amplitude.

5. A unit as in claim 2 wherein the sensor comprises an ambient condition sensor and the decision circuitry includes instructions which determine that the profile is present in response to a gradient of sampled amplitude values of the output exceeding a selected first value.

6. A unit as in claim 2 wherein the decision circuitry includes a storage unit wherein information defining a predetermined profile is stored therein, and wherein instructions are stored therein for increasing the sampling rate to the second rate in response to the sampled output from the sensor corresponding to the prestored information.

7. A unit as in claim 1 wherein the decision circuitry includes pattern recognition circuitry for determining that the profile is present in the output.

8. A unit as in claim 5 wherein the sensor comprises a photoelectric smoke sensor.

9. A unit as in claim 1 which includes at least a second, different sensor which generates a second output and including interface circuitry coupled to the decision circuitry wherein the profile determination is based, at least in part, on the second output.

10. A unit as in claim 9 wherein the decision circuitry includes circuitry for adjusting the sampling rate of the first output in response to a profile based, at least in part, on the second output and for adjusting a sampling rate of the second output in response to a profile based, at least in part, on the first output.

11. A unit as in claim 10 wherein the sensors are responsive to the presence of ambient conditions indicative of the presence of fire.

12. A unit as in claim 11 wherein the first sensor includes a smoke sensor.

13. A unit as in claim 10 wherein the first sensor includes a smoke sensor and the second sensor includes a sensor selected from a class which includes a gas sensor, a humidity sensor, a thermal sensor, a dust sensor and a velocity sensor.

14. A unit as in claim 10 wherein the decision circuitry comprises a programmable processor and a plurality of associated decision-related instructions coupled thereto, and, wherein the sampling rate adjusting circuitry comprises rate modifying instructions coupled to the processor.

15. A unit as in claim 4 wherein the rate modifying instructions both increase and decrease the sampling rates of the outputs.

16. A unit as in claim 15 wherein the first sensor comprises an optical-type smoke sensor and the second sensor comprises an ion-type smoke sensor.

17. A unit as in claim 1 which includes circuitry for processing the sampled output to thereby produce a processed output wherein the processing is alterable in response to increasing the sampling rate.

18. A unit as in claim 17 wherein the processing comprises filtering the sampled output and wherein the filtering is altered in response to increasing the sampling rate.

19. A unit as in claim 18 wherein the filtering is decreased in response to increasing the sampling rate.

20. In a condition monitoring system having at least one sensor, a method comprising;

sampling of data from a sensor;

establishing a rate of sampling the data;

processing the sampled data using at least one of algorithms and other logical means to form processed values; and prior to an alarm condition being determined, changing the rate of sampling of the data in response to the processed values exhibiting a selected profile.

21. A method, as in claim 20, where the sampling rate is increased if the processed values are increasing.

22. A method as in claim 20 where the sampling rate is increased if the processed values are exceeding a predetermined minimum value less than the alarm threshold.

23. A method, as in claim 20 where the sampling rate is increased if a plurality of the processed values exceed a predetermined threshold.

24. A method, as in claim 22, where the sampling rate is decreased if the processed values are less than a predetermined threshold.

25. A method, as in claim 21 wherein the sampling rate is increased if the profile of the processed values is similar to or matches a profile representative of a selected condition.

26. A method as in claim 21 wherein the sampling rate is decreased if the profile of the processed values is not similar to or is not matching a profile representative of a selected condition.

27. In an abnormal condition monitoring system such as a fire alarm system, a method comprising;

sampling of data from a sensor;

establishing a rate of sampling the data;

processing the sampling of the data using at least one of algorithms and other logical means; and prior to an alarm condition being determined, changing the rate of sampling of the data dependent upon a profile of the sampled data from the sensor.

28. A method as in claim 27 wherein the rate of sampling data is increased if the profile of the data from the sensor corresponds to the presence of a predetermined condition.

29. A method, as in claim 27, wherein the rate of sampling data is decreased if the profile of the data from a sensor does not correspond to the presence of a predetermined condition.

30. A method as in claim 27 wherein the rate of sampling data is increased if a gradient of the data from a sensor exceeds a preset value.

31. A method as in claim 27 wherein the rate of sampling data is decreased if the gradient of the data from a sensor does not exceed a preset value.

32. A method as in claim 27 wherein the rate of sampling data is increased if the profile of the data from a sensor is similar to or matches a profile representative of an abnormal condition.

33. A method as in claim 27 wherein the rate of sampling data is decreased if the profile of the data from a sensor is not similar to or does not match a profile representative of an abnormal condition.

34. A fire detector comprising:

a housing;

a fire sensor carried by the housing;

a sampling circuit coupled to the sensor;

sample rate establishing circuitry coupled to the sampling circuit;

processing circuitry coupled to the sampling circuit and to the establishing circuitry wherein the processing circuitry receives sampled values, indicative of outputs from the fire sensor, and wherein the processing circuitry provides at least one rate of change input to the rate establishing circuitry thereby causing that circuitry to establish a first quiescent rate and a second higher rate, in response to a predetermined profile which is independent of any fire threshold value.

35. A detector as in claim 34 wherein the processing circuitry includes pattern recognition circuitry for establishing the presence of the predetermined profile in a selected plurality of sampled values.

36. A detector as in claim 34 which includes a second, different sensor coupled to the processing circuitry for supplying profile related signals thereto.

37. A detector as in claim 36 wherein the processing circuitry includes pattern recognition circuitry for establishing the presence of the predetermined profile in the signals received from the second sensor.

38. A detector as in claim 34 wherein the processing circuitry includes a filter for filtering the sampled values to first and second different to degrees and circuitry for switching from one degree of filtering to another when the sample rate is altered.

39. A detector as in claim 38 which includes a second sensor which generates a profile establishing signal which is coupled to the processing circuitry.

* * * * *

UNITED STATES PATENT AND TRADEMARK OFFICE

CERTIFICATE OF CORRECTION

PATENT NO. : 6,222,456 B1
DATED : April 24, 2001
INVENTOR(S) : Lee D. Tice

It is certified that error appears in the above-identified patent and that said Letters Patent is hereby corrected as shown below:

Column 5,
Line 38, please cancel "41" and insert -- 42 --;
Line 58, please insert a -- , -- after "requirement" and cancel "a".

Signed and Sealed this

Twenty-sixth Day of February, 2002

*Attest:*

*Attesting Officer*

JAMES E. ROGAN
*Director of the United States Patent and Trademark Office*